United States Patent [19]

Penick

[11] 4,064,039

[45] Dec. 20, 1977

[54] FLUID CATALYTIC CRACKING

[75] Inventor: Joe E. Penick, Chappaqua, N.Y.

[73] Assignee: Mobil Oil Corporation, New York, N.Y.

[21] Appl. No.: 653,167

[22] Filed: Jan. 28, 1976

[51] Int. Cl.[2] ..... C10G 11/18

[52] U.S. Cl. ..... 208/160; 208/120; 208/164; 252/417

[58] Field of Search ..... 208/120, 160, 164, 159; 252/417

[56] References Cited

U.S. PATENT DOCUMENTS

| | | | |
|---|---|---|---|
| 2,386,491 | 10/1945 | McOmie | 208/160 |
| 2,436,927 | 3/1948 | Kassel | 252/417 |
| 2,477,345 | 7/1949 | Pelzer | 208/160 |
| 3,351,548 | 11/1967 | Payne et al. | 208/120 |
| 3,364,136 | 1/1968 | Chen et al. | 208/120 |
| 3,649,521 | 3/1972 | Martin | 208/120 |
| 3,650,990 | 3/1972 | Frillette | 252/455 Z |
| 3,660,310 | 5/1972 | Kluksdahl | 252/454 |
| 3,696,025 | 10/1972 | Chessmore | 208/113 |
| 3,718,553 | 2/1973 | Stover | 208/120 |
| 3,788,977 | 1/1974 | Dolbear | 208/120 |
| 3,849,291 | 11/1974 | Owen | 208/120 |
| 3,856,659 | 12/1974 | Owen | 252/417 |
| 3,894,934 | 7/1975 | Owen et al. | 252/417 |
| 3,909,392 | 9/1975 | Horecky et al. | 252/417 |
| 3,926,778 | 12/1975 | Owen et al. | 252/417 |

*Primary Examiner*—Herbert Levine

*Attorney, Agent, or Firm*—Charles A. Huggett; Michael G. Gilman; Alverna M. Paulan

[57] ABSTRACT

Modifying a heat balanced operating fluid catalytic cracking (FCC) system to utilize a platinum group metal modified cracking catalyst, whereby increasing the heat generated in the exothermic regeneration of coked catalyst, and to provide a regenerated catalyst heat exchange cooler to permit adjustment of cracking conditions independent of the extra heat produced in the regeneration of catalyst.

1 Claim, 4 Drawing Figures

FLUID CATALYTIC CRACKING

Figure 2:
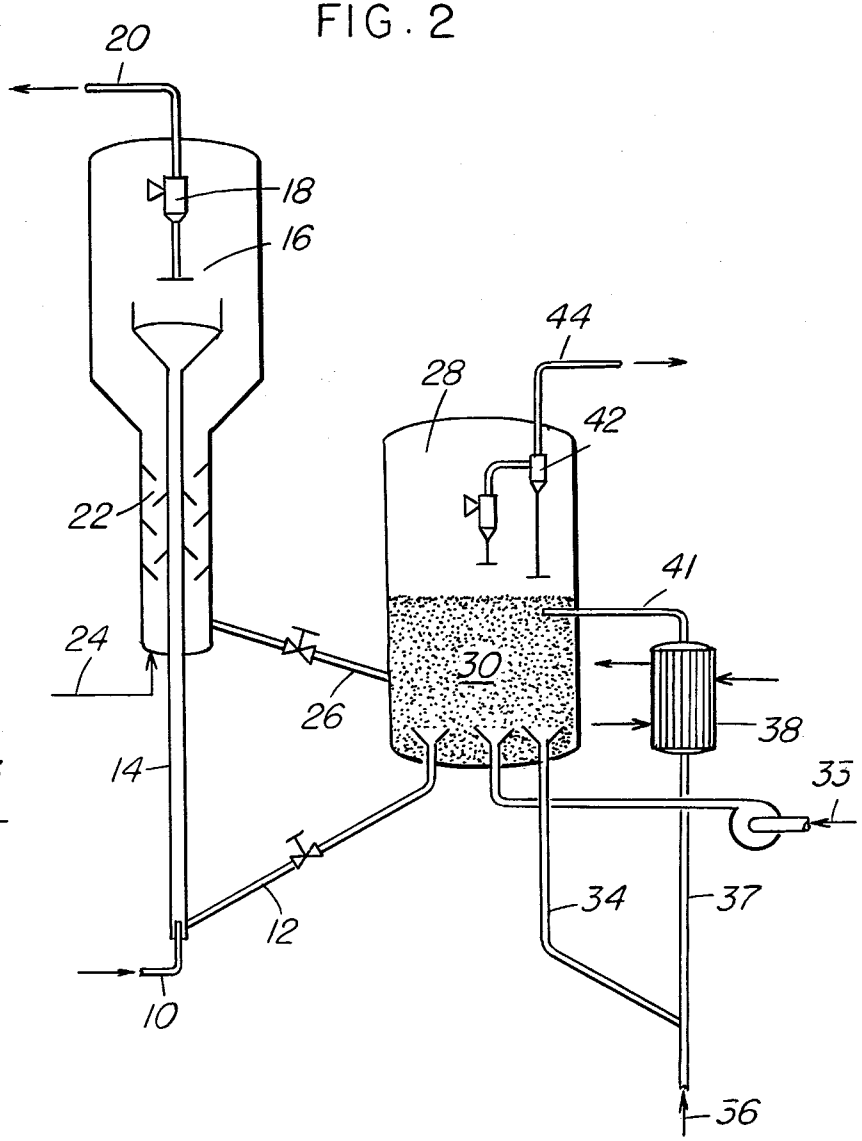

This invention relates to fluid catalytic cracking (FCC). It more particularly refers to improvements in the control of combustion of coke on spent catalyst during regeneration.

It is common commercial practice, both in the United States and elsewhere to produce gasoline, heating oil and Diesel fuel by cracking heavier petroleum fractions to these lighter, more valuable materials. One of the major commercial techniques for accomplishing this conversion is non-hydrogenative fluid catalytic cracking (FCC). In FCC, a feed petroleum fraction such as vacuum gas oil, is contacted with particles of hot, active catalyst at high temperatures and low pressures of about 1 to 5 atmospheres absolute in the absence of added hydrogen. The catalyst should be in sufficient quantity and at a sufficient temperature to vaporize the oil feed, raise the oil feed to a cracking temperature of about 900° to 1100° F and supply the endothermic heat of reaction. The oil and catalyst flow together (concurrently) for a time sufficient to carry out the intended conversion. During the conversion of the heavy petroleum fraction to lighter fractions, coke is layed down on the catalyst particles thereby deactivating them, and the thus coked, cooled catalyst particles, are separated from the cracked petroleum product, the product recovered and resolved, and the cooled, coked catalyst transported to a separate regenerator. In the regenerator the coked catalyst is combined with an oxygen containing gas, e.g., air, whereby coke is burned off the catalyst and the catalyst is both reactivated and heated. The heated, reactivated catalyst is then returned into admixture with further heavy oil feed, thus completing the cycle. Fluid catalytic cracking processes are generally designed to be heat balanced. That is, the burning of coke in the regenerator supplies enough heat, even taking loses into account, to satisfy all of the heat requirements of the system. There is a firm relationship between the amount of coke produced during cracking, the amount of coke burned off during regeneration and the heat which the reactivated heated catalyst returns to the cracking side of the process. Even this combination is not wholly independent and controllable because it is in turn partially influenced by the nature of the catalyst, its tendency to make more or less coke under given cracking conditions, and the nature of the petroleum fraction feed, its tendency to be converted to more or less coke under a given set of cracking conditions.

It has been the usual industrial practice to carefully work out a balance of all of the effects and countereffects in an FCC system and to adjust feeds, residence times, catalysts and other conditions to achieve a heat balanced operation. That is, the type of feed, feed rate, feed temperature, type of catalyst, catalyst to oil ratio, contact time, reaction temperature, etc., are adjusted on the cracking side so as to produce as desirable product slate as possible while depositing a sufficient amount of coke on the catalyst to satisfy the system.

When changes occur in the system, such as the inherent coking tendency of the feed, over which the refiner has little or no control, he has in the past always adjusted other operating variables to compensate and thereby maintain a heat balanced operation. Some, a small number, commercial units operate in heat imbalance using catalyst heat exchangers and air and/or feed preheaters to adjust the operations to the peculiar requirements of particular situations.

Recently there has been a considerable increase in the desire, on the art of refiners, to reduce emissions of carbon monoxide from FCC regenerator in the flue gas. This has in some cases been accomplished through the use of incinerators of CO boilers. Although these work well, they do represent substantial capital investment and they pose a problem with respect to maintenance and repair. Thus, when a separate on stream CO combustion system is taken out of line for routine or emergency repair and maintenance, there is an inherent increase in the CO emissions from the FCC regenerator. Therefore, in order to maintain the purity of stackgas within acceptable limits, it has been considered necessary to have back-up CO control systems or to modify the operation of the whole FCC or to vary from emission control requirements.

More recently substantial progress has been made toward modifying the operation of an FCC regenerator so as to reduce carbon monoxide in the off gas therefrom whereby reducing or eliminating the need for downstream CO combustion facilities. This is being accomplished by increasing the air feed to the regenerator and raising the regenerator temperature to an extent sufficient to support CO burning in the regenerator. Burning CO in the regenerator tends to increase the heat generated in the regenerator. This has some beneficial effects upon some FCC operations in that it reduces residual carbon on regenerated catalyst, it may permit a reduction in catalyst inventory, and/or a lower catalyst to oil ratio, and/or a higher cracking temperature. It may permit cracking feed stocks which are inherently low coke makers because burning less coke substantially all the way to carbon dioxide may generate sufficient heat to make up for the smaller amount of coke. It may also permit the use of more highly selective catalysts which give greater yields of lighter products but also produce less coke. Since an FCC system is heat balanced by design, burning carbon monoxide in the regenerator decreases the need for coke burning to satisfy the system's heat requirements. Thus, the coke produced by the cracking reaction is reduced which in turn reduces the flexibility of the operator. Thus, a new balance must be struck between producing little enough coke, to be burned all the way to $CO_2$, to satisfy the cracking side heat requirements, but high enough coke to keep the regenerator temperature high enough to support the combustion of carbon monoxide. This may be a very difficult balance to obtain and maintain.

Quite recently a substantial improvement has been made in the carbon monoxide burning capability of FCC regenerators with the introduction of special FCC catalysts containing very small amounts of platinum group metals or rhenium. These incredibly small quantities of metal, up to about 50 ppm, preferably up to about 10 ppm, or less have shown the ability to catalyze the burning of carbon monoxide in an FCC regenerator without substantially adversely effecting the selectivity of the catalyst on the cracking side of the process. It is of particular interest to note that these new catalysts seem to have the capability, under appropriate circumstances and operating conditions, of catalyzing the oxidation of carbon monoxide in that part of the regenerator where the catalyst particles are densely distributed rather than in that part of the regenerator where the catalyst particles are more widely dispersed. This causes the heat of CO combustion to be more readily and completely transferred to the catalyst particles rather than to the flue gases. Thus, a substantial portion of the heat of combustion of the carbon monoxide is directly transferable back to the cracking side of the FCC operation via increased catalyst temperature. Since the referred to new CO burning catalysts effectively operate to lower the temperature necessary in the regenerator to sustain CO combustion, and effectively bring the combustion of CO into an area of the regenerator which contains substantial proportions of catalyst, the amount of coke produced on the cracking side need only be that amount necessary to support the cracking side heat requirements and need not be concerned with maintaining an abnormally hot regenerator.

In some cases, even with the new desirably low coke making requirements of the system, the nature of the feed, or other parameters, may dictate that more coke must be made than is appropriate to permit the system to be heat balanced.

It is therefore an object of this invention to provide novel means of operating fluid catalytic cracking so as to minimize carbon monoxide in the regenerator flue gas as well as control the regenerator temperature.

Other and additional objects of this invention will become apparent from a consideration of this entire specification including the drawing and the claims hereof.

Understanding of this invention will be facilitated by reference to the accompanying drawing, the figures of which are schematic diagrams of fluid catalytic cracker systems embodying this invention.

In accord with and fulfilling these objects, one aspect of this invention resides in the modification of an otherwise substantially conventional fluid catalytic cracking system by utilizing a catalyst comprising a hydrocarbon cracking catalyst having a small proportion, up to about 50 parts per million, of a platinum group metal incorporated therewith and by cooling catalyst either between reactivation thereof and cracking therewith or via an internal cooling system in the regenerator, or preferably by withdrawing a portion of the catalyst from the regenerator, passing it through a heat exchange cooler, and returning the cooled catalyst back to the regenerator.

The heat exchange referred to may be direct and/or indirect. A portion of the catalyst inventory may be withdrawn from the regenerator, indirectly heat exchanged with water to produce steam, and then returned at a lower temperature to the regenerator. The catalyst withdrawn from the regenerator may be directly heat exchanged with cold air in order to reduce its temperature and then the cooled catalyst returned to the regenerator. It is also within the scope of this invention to utilize a combination of both direct and indirect heat exchange.

In one particularly preferred configuration, a portion of the catalyst in the regenerator is withdrawn from a lower part thereof, passed downwardly out of the regenerator, then lifted, usually with air, as a fluidized bed through an indirect water cooler and then reintroduced into an upper part of the regenerator. The cooled catalyst may alternatively be reintroduced into a lower part of the regenerator.

One particular type of fluid catalytic cracking system utilizes a regenerator having a "fixed" fluid bed of catalyst supported by an upward flowing stream of air. In this system there is usually a lower, dense fluidized bed of catalyst and an upper dispersed bed of catalyst. The lower, dense bed may in fact not be a uniform bed at all but may be a swirling mass of catalyst. In this type of regenerator the coked catalyst from the cracking side is introduced into the dense bed, sometimes with a tangential component. Air is passed upwardly through and tends to support the catalyst particles while combusting the coke thereon. Lighter particles tend to be carried higher than heavier particles and are projected upwardly into the dispersed phase. Cyclone separators are often used to separate catalyst particles in the dispersed phase from regeneration gas and to return the catalyst particles to the dense phase catalyst bed. The regenerated catalyst is usually withdrawn from the dense bed.

Another type of regenerator used in a fluid catalytic cracking has a dense lower bed of catalyst and a more dispersed upper bed of catalyst but differs from the first above described regenerator in that substantially all of the coked catalyst enters the lower dense bed and is lifted into the upper dispersed bed. Regenerated catalyst is taken from the upper dispersed bed and recycled back to the cracking side of the process. In this type of regeneration, known as riser regeneration, it is often desirable and may even be necessary, to recycle some hot regenerated catalyst from the dispersed phase back to the lower dense bed in order to insure that the equilibrium temperature of the dense bed is sufficiently high to sustain coke combustion therein.

According to the instant invention the fluid catalytic cracking catalyst comprises catalyst particles having incorporated therewith up to about 50 parts per million of rhenium and/or a platinum group metal.

Based upon total catalyst inventory, the rhenium or platinum group metal may be used in proportions as low as 0.0015 parts per million. More usual levels are 0.01 to 0.1 parts per million. These proportions envision mixing conventional cracking catalyst with such catalyst modified to catalyze CO combustion as set forth herein.

The catalyst may consist of particles all of which have such metal or may consist of particles only a portion of which have such metal incorporated therewith. In either case, while the incorporation of such small proportions of metals with the cracking catalyst is not considered to be per se inventive here, the use of such metal containing catalyst poses some unusual problems.

As has previously been set forth in other patent specifications, a platinum group metal as the term is used in the instant context is at least one of platinum, palladium, viridium, ruthenium, osmium, rodium or rhenium. It is recognized that rhenium is not ordinarily considered to be a platinum group metal, this subgenus being limited to the metals of Group VIII periods 5 and 6 of the Periodic Table. However, rhenium behaves like the traditional platinum group metals in the use to which they are being put here. Therefore, in this context, it is believed that the expressed modified definition is proper and justified. The amount of platinum group metal incorporated with the cracking catalyst must conform to maxima and a minima which are capable of functional definition. Since each of the seven metals, included in the group rhenium, platinum, palladium, ruthenium, osmium, irridium and rhodium, has a different level of activity, the functional definitions are more precise and are within the generic boundaries of the numerical range set forth above. The metal should be present in such minimum proportion, on individual catalyst particles, that its total concentration, based upon total catalyst inventory, is sufficient to support the combustion of carbon monoxide to carbon dioxide in the dense bed of the regenerator at the temperature at which the regenerator is operating and in the presence of sufficient oxygen to support this combustion. In particular, it should be noted that there is a relationship between the temperature of the regenerator, the amount of incorporated metal and the ignition of carbon monoxide in the dense phase. As the dense bed temperature increases, the amount of incorporated metal needed for carbon monoxide ignition decreases, and vice versa. In this regard, it should be understood that carbon monoxide burning is quite exothermic. The temperature necessary to sustain carbon monoxide combustion is often substantially lower than the temperature necessary to initiate combustion. Similarly, the proportion of incorporated metal necessary to initiate combustion may be higher than that required to sustain combustion. The maximum numerical value set forth above must therefore be considered as necessary to encompass all of these variables.

Insofar as the maximum proportion of incorporated metal is concerned, this relates to the previously recognized adverse effect that carbon monoxide oxidation catalysts have upon the total catalyst selectivity during cracking. In this regard it is known that these metals, in addition to catalyzing the combustion of carbon monoxide, also catalyze the dehydrogenation of naphthenes, the production of coke and the production of light ($C_4$−) gases during cracking. Again, as noted above, each of the seven metals hereof has a different catalytic effectiveness; that is each will be effective in a different proportion to cause a given amount of coke deposition, for example, at a given set of cracking conditions including feedstock definition. As a practical, functional matter, however, the maximum proportion of incorporated metal is that amount which will insubstantially effect the cracking side of the instant fluid catalytic cracking process; that is will effect the coke make, light gas make and gasoline selectivity to an extent only sufficient to stay within the design parameters of the system and its conventional auxiliary equipment, e.g. compressors and gas plant.

Taking all these matters into consideration and acknowledging the desirability of employing a fluid catalytic cracking catalyst having an appropriate proportion of rhenium, platinum, palladium, osmium, iridium, rhodium and/or ruthenium incorporated therewith, when this metal incorporation accomplishes its intended function of reducing the carbon monoxide combustion in the regenerator dilute phase and/or cyclones, and/or reduces or substantially eliminates carbon monoxide in the flue gas, the catalyst being regenerated is heated to a greater extent that otherwise in the operation of the same FCC system under otherwise the same conditions. When the recycled regenerated catalyst is too hot, this causes an excessive drop in catalyst/oil ratio, reduces conversion, changes selectivity and product distribution, and usually results in a decrease in desirable products, notably gasoline and isobutane, and an increase in less desirable light and heavy fuel oil. It has been found, according to this invention, however, that if a catalyst incorporating a metal as set forth herein which has the capability of catalyzing the combustion of carbon monoxide is used, restoring the temperature of the catalyst being fed to the cracking side to about its previous temperature has salutory effects upon the conversion and selectivity achieved on the cracking side. This requires cooling as noted above.

It is most interesting to note that especially at low regenerator dense bed temperatures, there is clearly a synergistic relationship between the temperature of the regenerated catalyst and how that temperature is achieved with respect to cracking effectiveness. That is, two otherwise identical cracking catalysts, one having a small amount of platinum metal as aforesaid and the other none, both regenerated to a substantially identical regenerator dense bed temperature, may have a different cracking effectiveness. What is more interesting still is the fact that because of the lower residual carbon on regenerated catalyst obtained when burning CO the cracking catalyst which has the platinum metal and has been cooled to achieve this prescribed dense bed temperature supports a higher conversion, higher gasoline yield, lower drygas ($C_2$−) make and lower coke make (based on feed) than the catalyst with no platinum metal and supports a higher conversion, higher gasoline make and lower coke make (based on feed) than with the same catalyst uncooled.

Referring now to the drawing, a hydrocarbon feed 10 enters the base of a riser reactor 14 in admixture with hot active catalyst 12. The cracking reactions in the riser produce a hydrocarbon product and cooled, coked catalyst which separate in the upper zone 16. Further separation of catalyst and product is accomplished by cyclone separators such as shown at 18 from which the hydrocarbon product is recovered at 10. The catalyst is deposited in the stripping section 22 into which steam 24 is introduced to displace as much hydrocarbon product as possible from the catalyst. The coked catalyst passes down a tube 26 into the dense bed 30 of a regenerator. Air 33 is pumped into the base of the regenerator at 32 fluidizing the catalyst particles and burning coke thereoff of. The combustion gases force some catalyst particles upwardly into a dispersed phase 28 with the flue gas 44 exiting through cyclones 42 which separate catalyst therefrom.

Figure 1:
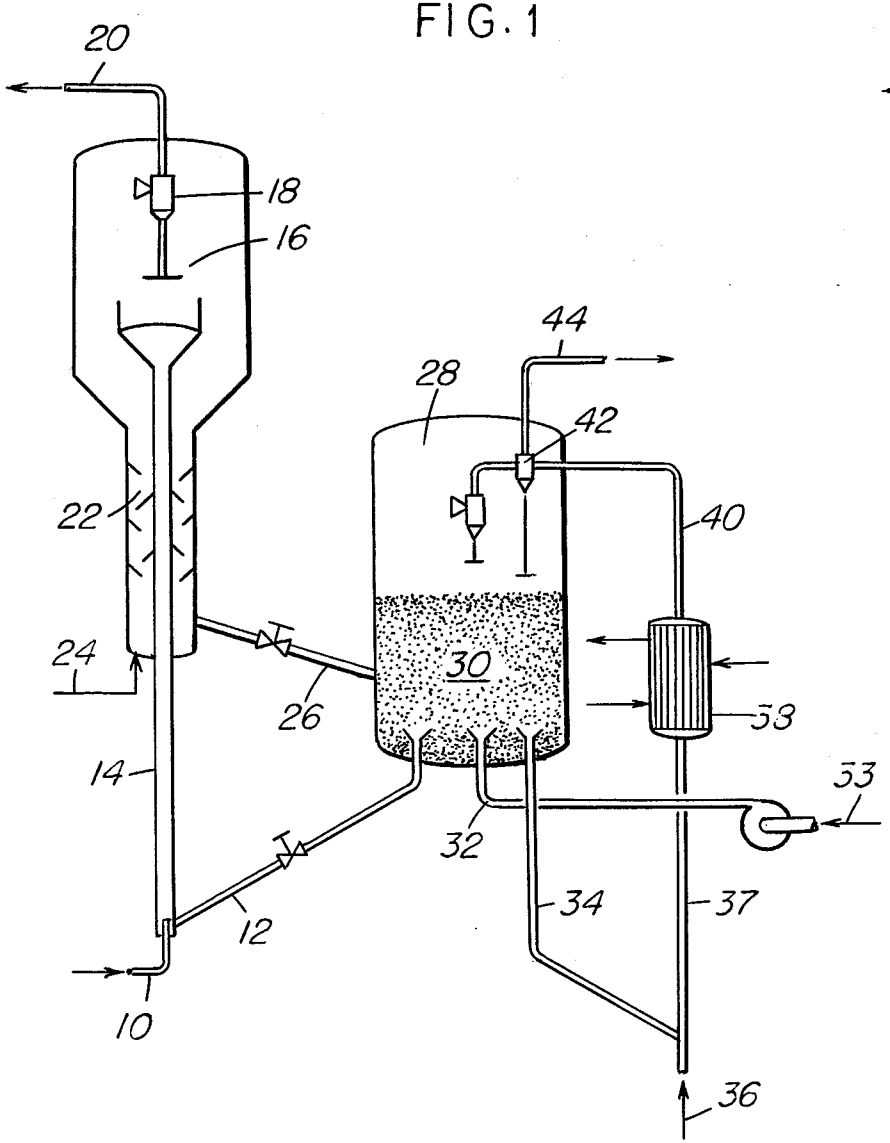

According to one aspect of this invention illustrated in FIG. 1, some catalyst is withdrawn from the regenerator at 34 and then is lifted, possibly with air 36 through a pipe 37 through a water cooled heat exchanger 38 and thence returned, via line 40, to the dilute phase in the regenerator.

In another embodiment shown in FIG. 2, the cooled, regenerated catalyst emerging from the heat exchanger 38 is returned to the dense bed of the regenerator via a line 41.

Figure 3:
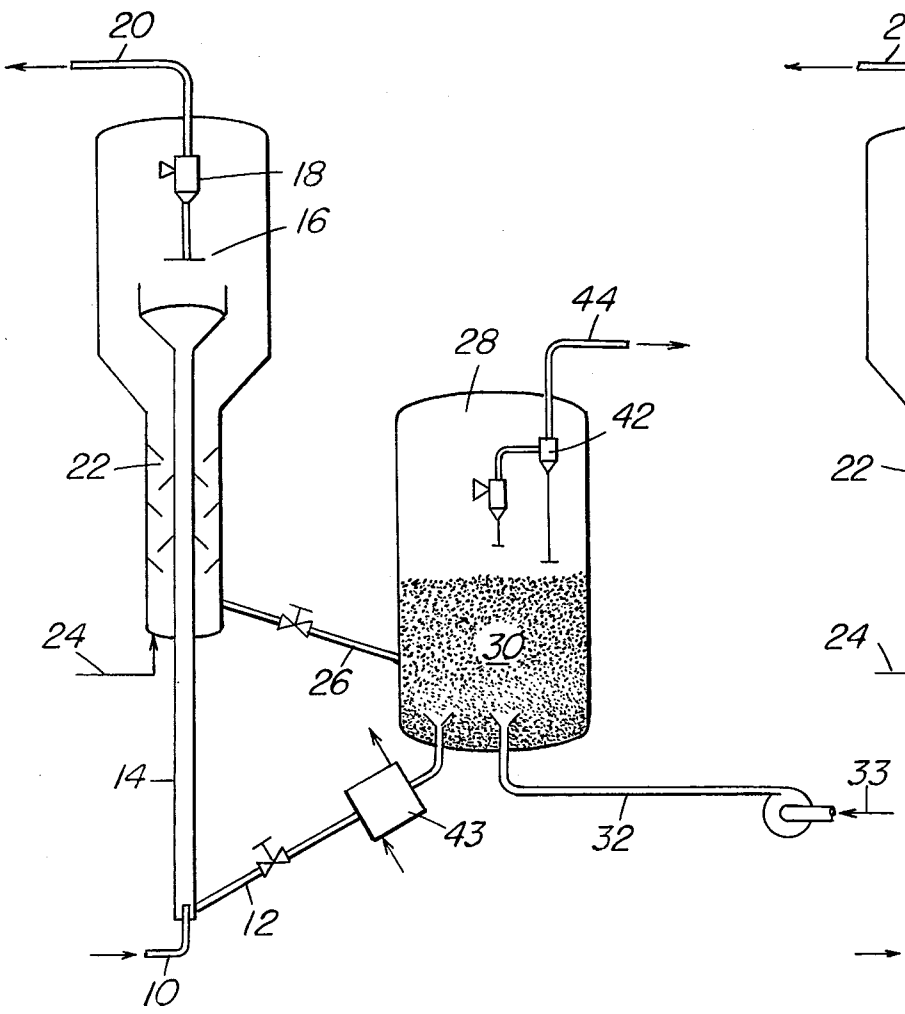

In a further embodiment shown in FIG. 3, regenerated catalyst leaving the regenerator 30 via a stand pipe 12 is subjected to indirect heat exchange, for example using a water cooler 43.

Figure 4:
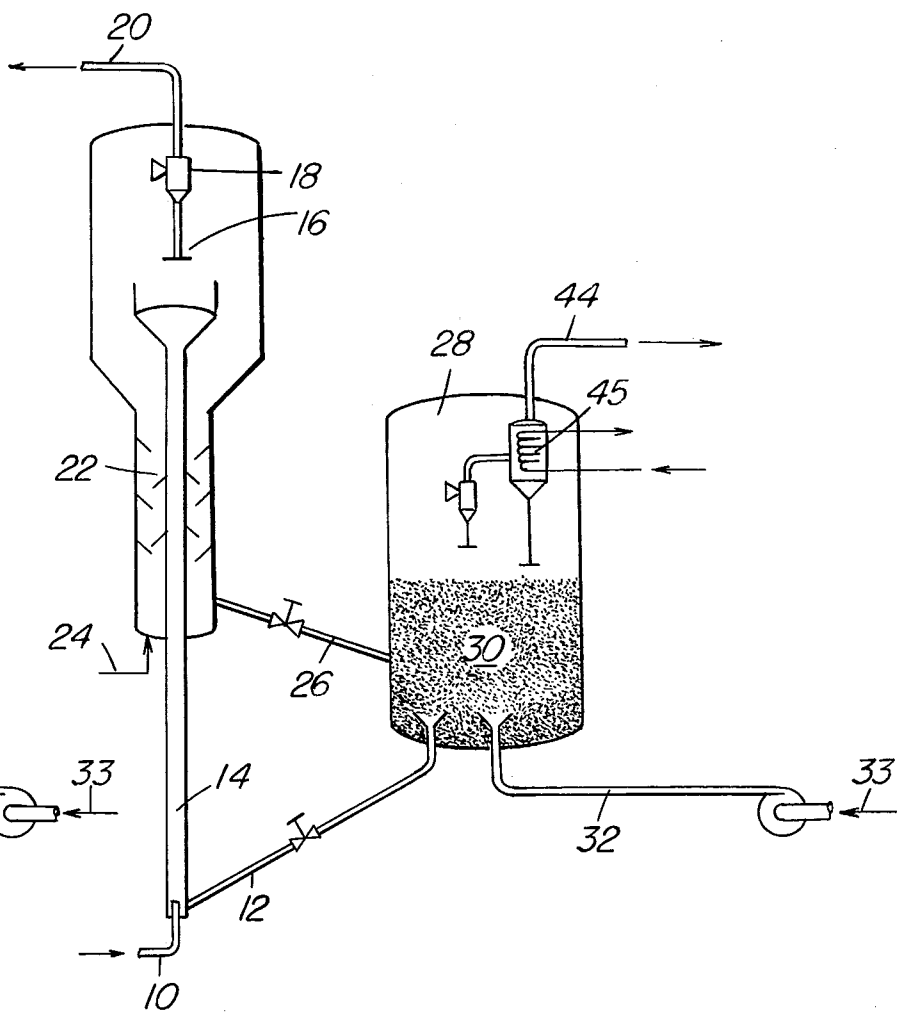

In a still further embodiment shown in FIG. 4, internal cooling of the catalyst in the regenerator is accomplished by providing one or more water cooled primary cyclones such as shown diagrammatically at 45.

In an example of one particular type of operation envisioned by this invention, an FCC unit operating on a relatively high coking feed gas oil was conventionally operated at a regenerator dense bed temperature of about 1250° F with conventional FCC zeolite/amorphous matrix cracking catalyst. When this catalyst was modified to include a minute amount of controlled CO burning catalyst as described herein, this regenerator temperature increased almost 100° F while on the cracking side more fuel oil but less gasoline were produced. Under the same circumstances but with catalyst cooling according to this invention to again provide a regenerator dense bed temperature of about 1250° F, conversion was increased as was gasoline yield. The following Table sets forth these data in more detail.

TABLE 1

| | Conventional Operation | CO Burning No Cooling | Δ | CO Burning Cooling | Δ |
|---|---|---|---|---|---|
| Regenerator Dense Bed Temp., ° F | 1252 | 1339 | | 1250 | |
| Catalyst Circulation, TPM | 61 | 46 | | 61 | |
| Carbon on Regen. Catalyst, % wt. | .17 | .03 | | .09 | |
| Conversion, % vol FF | 68.4 | 65.1 | −3.3 | 70.3 | +1.9 |
| Gasoline, % vol (390° F at 90%) | 49.1 | 47.5 | −1.6 | 50.4 | +1.3 |
| LFO, % vol. | 24.3 | 25.6 | +1.3 | 23.4 | −0.9 |
| HFO, % vol. | 7.3 | 9.3 | +2.0 | 6.3 | −0.1 |
| $C_4$'s, % vol. | 12.2 | 11.5 | −0.7 | 12.7 | +0.5 |
| $C_3$'s, % vol. | 8.4 | 7.9 | −0.5 | 8.7 | +0.3 |
| $C_2$ and lighter, % wt. | 5.2 | 4.9 | −0.3 | 4.4 | −0.8 |
| Coke, % wt. | 7.5 | 6.5 | −1.0 | 7.8 | +0.3 |
| Total cooling duty, mm Btu/hr | — | — | — | 138 | +138 |
| Gasoline Efficiency % | 71.8 | 73.0 | | 71.6 | |

In a further illustration of the practice of this invention, another set of runs shows differences in results based upon using a platinum group metal modified cracking catalyst without cooling, with cooling and return to regenerator dilute phase as shown in FIG. 1, and with cooling and return to regenerator dense phase as shown in FIG. 2. These data are detailed in the following Table 2.

TABLE I

| | | 1225° F Catalyst Temperature to Riser | | | |
|---|---|---|---|---|---|
| | Base | Cooled Catalyst Returned to Regn. Dilute Phase (FIG. 1) | Δ From Base | Cooled Catalyst Returned to Dense Phase (FIG. 2) | Δ From Base |
| Conversion, % Vol. FF | 68.4 | 71.5 | +3.1 | 73.2 | +4.8 |
| Gasoline, % vol, 390° F at 90% | 49.1 | 50.9 | +1.8 | 52.1 | +3.0 |
| Coke, % wt. | 7.5 | 8.2 | +0.7 | 8.7 | +1.2 |
| Total Cooling Duty, mm Btu/hur | — | 185 | +185 | 198 | +198 |
| $CO_2$/CO Ratio | 1.6 | ∞ | — | ∞ | — |
| Carbon on Regen. Cat., % wt. | 0.17 | 0.12 | −.05 | 0.02 | −0.15 |
| Regen. Dense Bed Temp., ° F. | 1252 | 1225 | − 27 | 1310 | + 58 |

| | | 1250° F Catalyst Temperature To Riser | | | |
|---|---|---|---|---|---|
| | Base | Cooled Catalyst Returned to Regen. Dilute Phase (FIG. 1) | Δ From Base | Cooled Catalyst Returned to Dense Phase (FIG. 2) | Δ From Base |
| Conversion, % vol FF | 68.4 | 70.3 | +1.9 | 71.3 | +2.9 |
| Gasoline, % vol. 390° F at 90% | 49.1 | 50.4 | +1.3 | 51.2 | +2.1 |
| Coke, % wt. | 7.5 | 7.8 | +0.3 | 8.1 | +0.6 |
| Total Cooling Duty, mm Btu/hr | — | 138 | +138 | 142 | +142 |
| $CO_2$/CO Ratio | 1.6 | ∞ | — | ∞ | — |
| Carbon on Regen. Cat., % wt. | 0.17 | 0.09 | −.08 | 0.03 | −.14 |
| Regen. Dense Bed Temp., ° F. | 1252 | 1250 | − 2 | 1317 | + 65 |

What is claimed is:

1. In the process of reflexive, endothermic, non-hydrogenative cracking of hydrocarbons comprising cofeeding hot active cracking catalyst and feed hydrocarbons to a reaction zone; cracking said feed, coking said catalyst and cooling such in said reaction zone; separating cracked product from coked catalyst; regenerating coked catalyst by fluidizing such with an oxygen containing gas in an amount and at a temperature sufficient to burn coke off said catalyst whereby heating and reactivating said catalyst and producing a flue gas comprising carbon oxides in a regeneration zone; and returning said heated, reactivated catalyst to said reaction zone at predetermined temperature; the improvement which comprises modifying said cracking catalyst by incorporating up to about 50 parts per million of at least one platinum group metal therewith; providing sufficient increased oxygen to burn more carbon monoxide and to produce a flue gas containing less carbon monoxide and more carbon dioxide than would apply without sid platinum group metal whereby increasing the temperature of said regenerated catalyst above said predetermined temperature; maintaining a regenerator temperature high enough to support said catalyzed carbon monoxide burning; and cooling at least a portion of said higher temperature regenerated catalyst by indirect heat exchange with water within a cyclone separator to provide a regenerated catalyst returned to said reaction zone at about said predetermined temperature.

* * * * *

UNITED STATES PATENT AND TRADEMARK OFFICE

CERTIFICATE OF CORRECTION

PATENT NO. : 4,064,039

DATED : December 20, 1977

INVENTOR(S) : Joe E. Penick

It is certified that error appears in the above-identified patent and that said Letters Patent are hereby corrected as shown below:

| | |
|---|---|
| Col. 6, line 26 | "10" should be --20--. |
| Col. 7, line 25 | "Table 1" should be --Table 2--. |
| Col. 8, line 18 (Claim 1) | Insert --a-- before "predetermined". |
| Col. 8, line 47 (Claim 1) | "sid" should be --said--. |
| Col. 8, line 54 (Claim 1) | After "tor" insert --in said regeneration zone to an extent sufficient--. |

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*